United States Patent [19]

Scholle

[11] 4,123,204

[45] Oct. 31, 1978

[54] DOUBLE-ACTING, FLUID-OPERATED PUMP HAVING PILOT VALVE CONTROL OF DISTRIBUTOR MOTOR

[75] Inventor: William R. Scholle, Corona del Mar, Calif.

[73] Assignee: Scholle Corporation, Northlake, Ill.

[21] Appl. No.: 756,495

[22] Filed: Jan. 3, 1977

[51] Int. Cl.[2] ..... F04B 17/00; F04B 35/00; F01L 25/02

[52] U.S. Cl. ..... 417/393; 417/395; 417/397; 91/307; 91/329

[58] Field of Search ..... 417/404, 397, 393, 395; 91/341 A, 329, 307

[56] References Cited

U.S. PATENT DOCUMENTS

| | | | |
|---|---|---|---|
| 274,879 | 3/1883 | Barton et al. | 91/341 A |
| 571,751 | 11/1896 | Crocker | 417/393 |
| 1,453,561 | 5/1923 | Willshaw | 417/393 |
| 2,625,886 | 1/1953 | Browne | 417/393 |
| 3,056,353 | 10/1962 | Peters | 417/393 |
| 3,329,094 | 7/1967 | Harklan | 417/393 |
| 3,741,684 | 6/1973 | Sobieralski | 417/404 |
| 3,741,687 | 6/1973 | Rupp | 417/404 |

FOREIGN PATENT DOCUMENTS

| | | | |
|---|---|---|---|
| 1,476,653 | 5/1969 | Fed. Rep. of Germany | 417/397 |
| 110,560 | 5/1900 | Fed. Rep. of Germany | 417/393 |
| 586,379 | 3/1925 | France | 417/404 |

*Primary Examiner*—Carlton R. Croyle
*Assistant Examiner*—Thomas I. Ross
*Attorney, Agent, or Firm*—Gary, Juettner & Pyle

[57] ABSTRACT

A reciprocating, fluid operated pump, which is reversed at opposite ends of its travel by shifting of a directional valve, is characterized by a control valve for rapidly and completely shifting the directional valve.

In the disclosed embodiment, the pump includes a pair of pumping portions each operated by a respective reciprocating air motor. The air motors are coupled for conjoint reciprocation, and the directional valve alternately applies compressed air to one and then to the other of the air motors. The arrangement is such that when air is applied to one of the motors fluid is forced from its associated pumping portion to an outlet from the pump while fluid is drawn into the other pumping portion from an inlet to the pump, and when air is applied to the other of the motors fluid is forced from its associated pumping portion to the outlet from the pump while fluid is drawn from the pump inlet into the one pumping portion. The control valve is actuated in response to reciprocating movement of the air motors to each opposite end of their travel to positively, rapidly and completely shift the directional valve, whereby a continuous and substantially constant pressure flow of fluid is provided at the pump outlet.

As a consequence of using a control valve to operate the directional valve, as compared with using some mechanical means directly coupling movement of the valve with movement of the motors, the operation of the directional valve is very positive and rapid, and the period during which compressed air is applied to neither of the motors is minimized, whereby the pump is efficient and the fluid outlet pressure therefrom remains substantially constant.

3 Claims, 5 Drawing Figures

DOUBLE-ACTING, FLUID-OPERATED PUMP HAVING PILOT VALVE CONTROL OF DISTRIBUTOR MOTOR

BACKGROUND OF THE INVENTION

The present invention relates to pumps in general, and in particular to an improved, reciprocating, air operated pump for fluids.

Compressed air operated pumps find use where relatively inexpensive, low volume pumps are required, or in situations where electric power for the motors of conventional electrically operated pumps is not available. As such pumps depend upon an external supply of compressed air for their power, they generally do not include the bulk and expense of pumps having integral power sources.

Air operated pumps ordinarily include an air cylinder or the equivalent as an air motor for operating a fluid pumping portion of the pump, and a shift valve is often used as a means for selectively applying compressed air to inlets to the cylinder to reciprocatingly move the cylinder to operate the pumping portion. The shift valve is usually mechanically linked directly with the cylinder for operation thereby, whereby at opposite ends of the cylinder travel the valve switches the application of air alternately between the inlets to provide for reciprocating movement of the cylinder. Unfortunately, since the valve is constrained to movement with the cylinder, with conventional pumps there is ordinarily a relatively long period of time, as the cylinder approaches opposite ends of its travel, when the shift valve, in switching from a connection with one inlet to another, does not apply compressed air through any inlet. This results in a decrease in the capacity of the pump and in the efficiency of operation thereof.

OBJECTS OF THE INVENTION

An object of the present invention is to provide an improved and efficient air operated pump of economical construction.

Another object of the present invention is to provide such a pump of the reciprocating type, wherein a shift valve for controlling the application of compressed air to inlets thereto is rapidly and completely operated by a control valve.

SUMMARY OF THE INVENTION

In accordance with the present invention, a reciprocating fluid operated pump, which is reversed at opposite ends of its travel by a shift valve, includes a control valve which operates the shift valve to ensure rapid and complete shifting thereof.

In a preferred embodiment of the invention, the pump includes a pair of pumping portions each operated by a respective reciprocating air motor. The air motors are coupled for conjoint reciprocation, and the shift valve alternately applies compressed air to one and then to the other of the air motors. The arrangement is such that when air is applied to one of the motors fluid is forced from its associated pumping portion to an outlet from the pump while fluid is drawn into the other pumping portion from an inlet to the pump, and when air is applied to the other of the motors fluid is forced from its associated pumping portion to the outlet from the pump while fluid is drawn from the pump inlet into the one pump portion. Means are provided for actuating the control valve as the air motors closely approach opposite ends of their travel to cause the control valve to rapidly and completely move the shift valve from its then position to its other position to reverse the direction of movement of the pumps.

The invention thus provides an improved and efficient air operated pump. As a consequence of the use of the control valve to operate the shift valve, as compared with directly mechanically linking the shift valve with the pumps for movement thereby, the operation of the shift valve is very rapid. This minimizes the time during which no air is applied to either pump, whereby the efficiency and the capacity of the pump is increased, and the output pressure of the fluid pumped thereby remains substantially constant.

DETAILED DESCRIPTION

Figure 1:
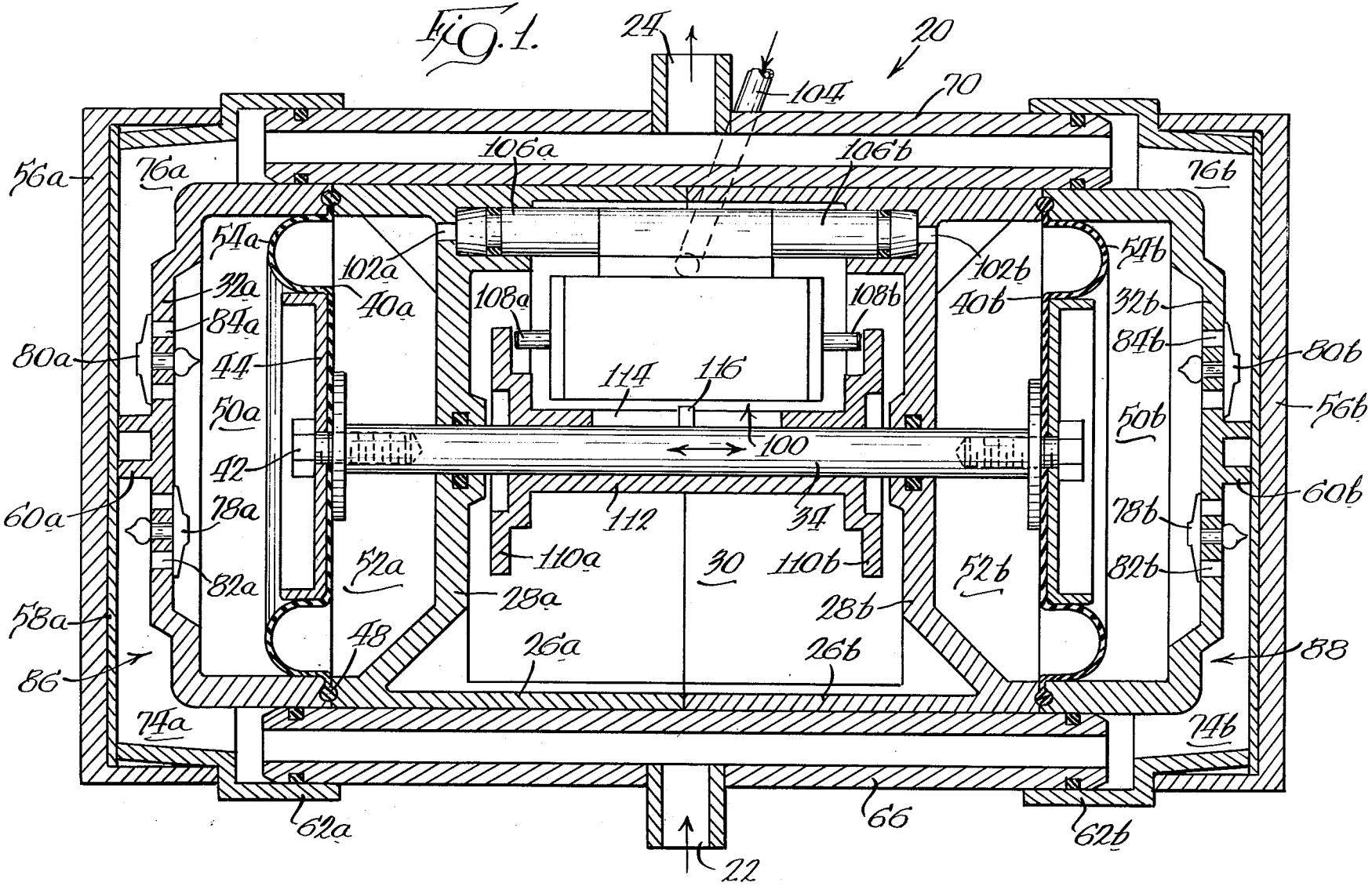
FIG. 1 is an elevation view, partly in cross-section, of an air operated pump structured in accordance with the teachings of the invention, and illustrates the interconnection of a pair of reciprocating pumps by a shaft, and a control mechanism responsive to movement of the shaft to selectively apply compressed air to one or to the other of the pumps.

Referring to the drawings, there is shown a reciprocating, double acting, fluid or air operated pump, indicated generally at 20, structured in accordance with the teachings of the invention. The pump includes a plurality of symmetrically formed, easily assembled housing sections facilitating economical manufacture thereof, which may be of any suitable material. In a preferred construction the pump housing sections are economically formed of a plastic material which is sufficiently rigid and shape retentive to provide adequate support for the working parts thereof, but yet is resilent enough to resist breaking. The pump has an inlet port 22 for being connected with a supply of a fluid to be pumped, and an outlet port 24 from which the fluid is provided under pressure, and is particularly suited for relatively low volume, constant pressure pumping operations, such as for providing a concentrated beverage syrup to a dispenser which mixes the syrup with soda water or other suitable diluent in the dispensing of a drinkable beverage.

As shown in FIG. 1, the pump includes a pair of inner, cylindrical, symmetrically formed housing sections **26*a* and 26*b*, having respective divider walls 28*a* and 28*b*, which are abutted at inner ends thereof to form a chamber 30. A pair of symmetrical and cylindrical pump housings 32*a* and 32*b* close outermost ends of the housings 26*a* and 26*b*, and a shaft 34 is extended through centrally located passages in the divider walls and slidably sealed therewithin by O-rings. One end of the shaft is fastened to a generally circular diaphragm or bellows 40***a* of rubber or other suitable flexible material by a fastener 42 threaded into the end of the shaft and capturing the diaphragm between a relatively large plate 44 and a somewhat smaller plate 46 which provide support therefor. A rib or bead 48 formed around the circumference of the diaphragm is sealingly captured within channels formed in abutting edges of the pump housing 32*a* and the inner housing 26*a*, whereby the diaphragm forms a pair of sealed chambers 50*a* and 52*a* between the housings. The other end of the shaft is similarly fastened to a diaphragm or bellows 40*b* by a fastener and a pair of plates, the diaphragm having a circumferential rib or bead captured within channels formed in abutting edges of the housings 28*b* and 32*b* to form a pair of sealed chambers 50*b* and 52*b* between the housings. Outer areas of the diaphragms are formed with bulbous portions 54*a* and 54*b*, whereby the diaphragms are free to flex along the axis of the shaft. In the operation of the pump the chambers 50'a and 50*b* form fluid pumping chambers, and the chambers 52*a* and 52*b* form air receiving chambers or air motors, as will be described.

A pair of cylindrical and symmetrical end caps or closures 56*a* and 56*b* are positioned over opposite ends of the pump, and have inner surfaces 58*a* and 58*b* engaging and forming a seal with a pair of diagonally extending ribs 60*a* and 60*b* of the pump housings 32*a* and 32*b*. The caps 56*a* and 56*b* include housing portions 62*a* and 62*b*, and a pair of conduits 66 and 70 are extended between mating inlets in the housing portions and are sealed therewith by O-rings. The conduit 66 forms a fluid passage from the fluid inlet port 22 to a pair of fluid inlet chambers 74*a* and 74*b*, and the conduit 70 forms a fluid passage between the outlet port 24 and a pair of fluid outlet chambers 76*a* and 76*b*, with the diagonal extensions 60*a* and 60*b* sealingly maintaining separate the fluid inlet and the fluid outlet chambers. While not shown, to fasten together the aforedescribed assembly, a plurality of elongated bolts or other suitable fasteners may be extended between the end caps.

One-way flapper valves 78*a* and 80*a* normally seal ports 82*a* and 84*a* formed through the pump housing 32*a*, and one-way flapper valves 78*b* and 80*b* normally seal ports 82*b* and 84*b* formed through the pump housing 32*b*. This forms a first fluid pump or pumping portion, indicated generally at 86, which includes the chamber 50*a*, and a second fluid pump or pumping portion, indicated generally at 88, which includes the chamber 50*b*. With conjoint reciprocating movement of the diaphragms because of the shaft 34, the pump 86 draws fluid from the inlet port 22 while the pump 88 provides fluid under pressure to the outlet port 24, and vice versa. More particularly, with movement of the diaphragms to the right, fluid is drawn from the inlet port and into the chamber 50*a* past the flapper valve 78*a*, while fluid is pumped from the chamber 50*b* to the outlet port past the flapper valve 80*b*, the valves 78*b* and 80*a* being urged closed at this time. Then, with movement of the diaphragms to the left, fluid is drawn through the inlet port and into the chamber 50*b* past the flapper valve 78*b*, while fluid is pumped from the chamber 50*a* to the outlet port past the flapper valve 80*a*, the valves 78*a* and 80*b* being urged closed at this time. The pump is thus double acting, with one pumping chamber 50*a* and 50*b* pumping while the other is filling, and vice versa.

To reciprocate the diaphragms to operate the pump a control mechanism, indicated generally at 100, is positioned within the chamber 30 and is responsive to movement of the shaft closely toward opposite ends of its travel to apply compressed air alternately through a pair of ports 102*a* and 102*b* into the chambers 52*a* and 52*b* of the air motors. The control mechanism receives compressed air through an air inlet 104 from a supply thereof (not shown), and is connected with the ports 102*a* and 102*b* through a pair of conduits 106*a* and 106*b* received within mating passages in the walls 28*a* and 28*b* and sealed therewith by O-rings. Upon entry of compressed air into one of the chambers, the diaphragm associated therewith is urged in a direction to exert a pumping force on the fluid in its pumping chamber and to move the other diaphragm, through the connecting shaft, in a direction to cause filling of its associated pumping chamber.

The control mechanism 100 includes a pair of plungers 108*a* and 108*b* for being engaged and depressed by radial flanges 110*a* and 110*b* of a spool-shaped member 112, slidably received about the shaft, as the shaft closely approaches opposite ends of its travel. The center body portion of the spool has a longitudinal slot 114 formed therethrough into which a shaft pin 116 extends. With compressed air being introduced into the chamber 52*a*, upon movement of the shaft toward the leftmost end of its travel the pin engages the spool at the left end of the slot and moves the spool in a direction to engage and depress the plunger 108*b* with the flange 110*b*. This causes the control mechanism to switch the introduction of air from into the chamber 52*a* to into the chamber 52*b*, while simultaneously venting to atmosphere the chamber 52*a*, to move the diaphragms, and therefore the shaft, to the right. Then, as the shaft approaches the rightmost end of its travel the pin engages the spool at the right end of the slot and moves the spool in a direction to engage and depress the plunger 108*a* with the flange 110*a*. This causes the control mechanism to switch the introduction of air from into the chamber 52*b* to into the chamber 52*a*, while simultaneously venting to atmosphere the chamber 52*b*, to again move the diaphragms, and therefore the shaft, to the left, whereupon the described cycle of operation is repeated. The control mechanism thus alternately and successively operates the air motors to alternately and successively cause the diaphragms to pump fluid from one of the pumping chambers 50*a* and 50*b* while simultaneously drawing fluid into and filling the other pumping chamber, whereby an uninterrupted flow of fluid is provided at the outlet 24 of the pump.

Figure 2:
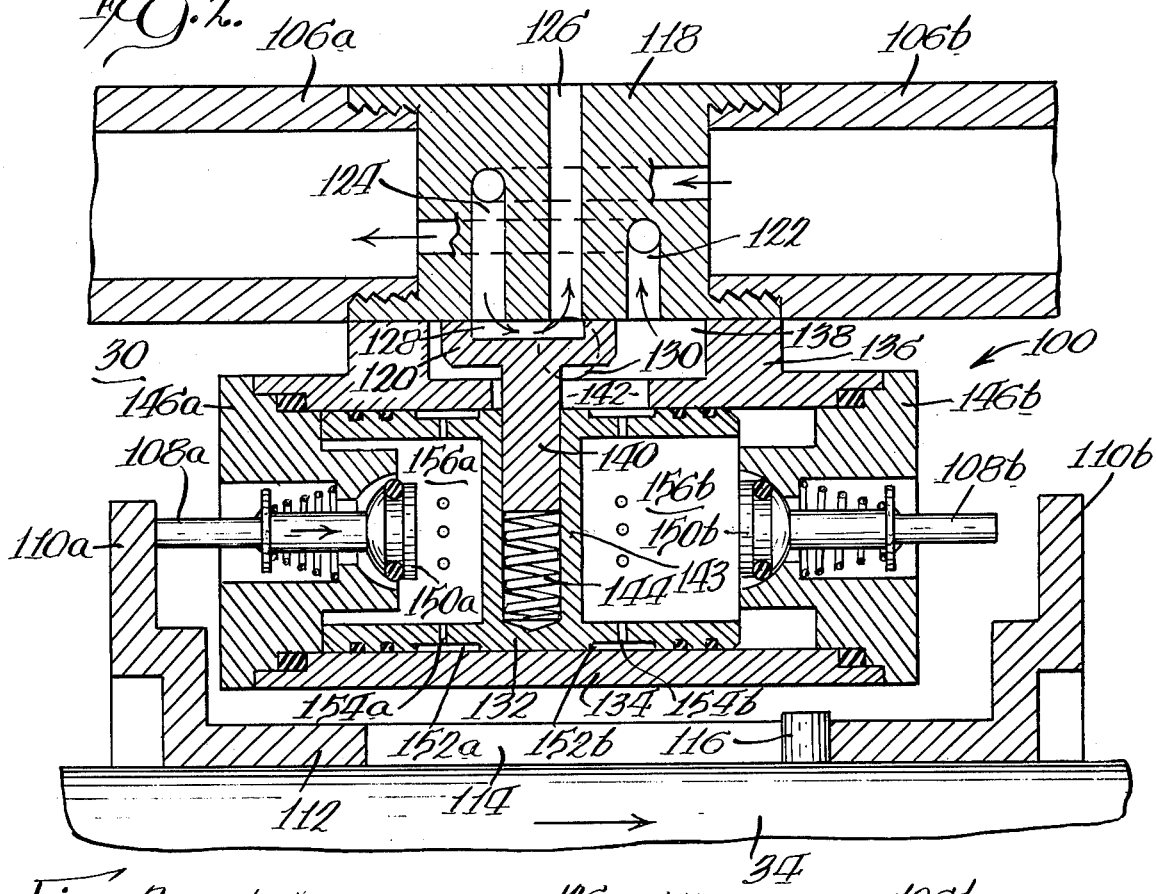
FIG. 2 is a cross-section view of the control mechanism, and illustrates the mechanism as the shaft approaches one end of its travel.
Figure 3:
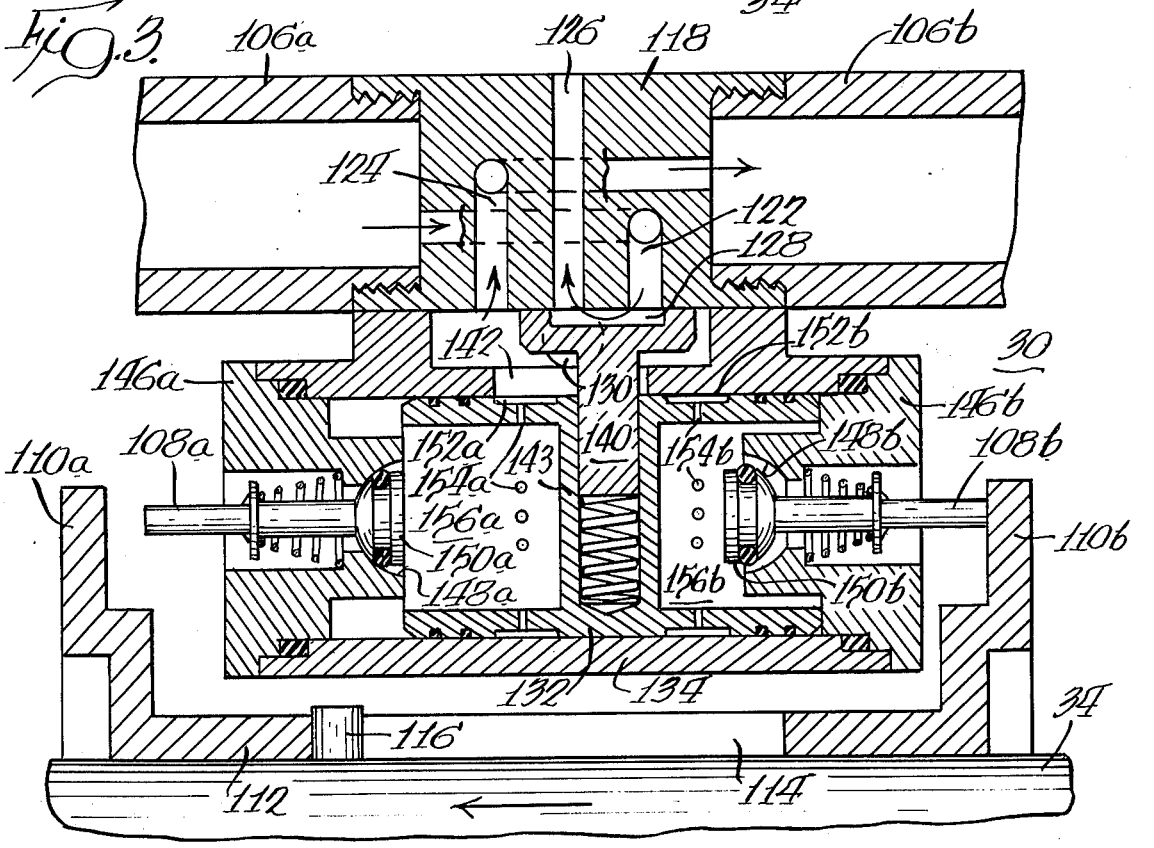
FIG. 3 is similar to FIG. 2, and shows the control mechanism as the shaft approaches the opposite end of its travel.

Referring particularly to FIGS. 2 and 3, the control mechanism is comprised of directional valve means for selectively controlling the introduction of compressed air to one of the chambers 52*a* or 52*b*, and control valve means for positively and rapidly operating the directional valve means. The directional valve means includes a directional manifold 118 and a shift or slide valve 120, which in the present invention is a "D" valve. The manifold has passages 122 and 124 communicating with the conduits 106*a* and 106*b*, respectively, and a passage 126 vented to atmosphere. The slide valve is movable across a surface of the manifold to selectively connect one of the passages 122 or 124 with the passage 126 through a centrally located recessed area 128 formed in the valve, with the other passage at that time then connected with compressed air at an outlet 130 from the air inlet 104.

The control valve means includes a cylindrical slide 132 positioned within a passage through a valve housing 134 and slidably sealed therewith by a plurality of O-rings. A rib or wall area 136 of the housing is joined with the manifold, and forms therewith a cavity 138 for receiving an upper end of the shaft valve and for directing the air from the outlet 130 to the passage 122 or 124 not then connected by the valve with the passage 126. The shift valve has a lower extension 140 passing through a longitudinal slot 142 in the valve housing and received within a passage formed in a central body portion or wall area 143 of the slide 132. The wall divides the slide into two half sections, and a spring 144 within the passage urges the valve against the manifold to enhance the seal therebetween. Movement of the slide thus moves the shift valve across the surface of the manifold to selectively apply compressed air to one of the chambers **52*a* or 52*b***, while simultaneously venting to atmosphere the other chamber.

A pair of identical end caps **146*a* and 146*b* close opposite ends of the passage through the valve housing. The caps have valve seats 148*a* and 148*b*, and spring loaded valves 150*a* and 150*b* which are normally spring urged to their closed positions, but which are movable to their open positions away from the valve seats by engagement of the flanges 110*a* and 110*b* with the plungers 108*a* and 108*b*. A pair of outer annular grooves 152*a* and 152*b* formed around opposite halves of the slide 132 receive compressed air through the slot 142, and a plurality of apertures 154*a* and 154*b* formed through the slide between the grooves and inner chamber sections 156*a* and 156*b* of the slider admit compressed air thereto. The chamber 30 is vented to atmosphere, whereby upon opening of the valve 150*a*, as shown in FIG. 2, a positive pressure in the chamber 156*b* with respect to that in the chamber 156*a* rapidly and completely moves the slide, and therefore the shift valve, to the left, and upon opening of the valve 150*b*, as shown in FIG. 3, a positive pressure in the chamber 156*a* with respect to that in the chamber 156*b*** rapidly and completely moves the slide to the right. With neither valve open, the chamber pressures are equal and the slide does not move.

In the operation of the pump, as the shaft closely approaches the rightward end of its travel, as shown in FIG. 2, the flange **110*a* engages and depresses the plunger 108*a* to open the valve 150*a* and cause the slide to rapidly, positively and completely move the shift valve leftward to a position connecting the manifold passage 124 with the passage 126, and the manifold passage 122 with compressed air at the outlet 130. As a result, compressed air is applied through the port 102*a* to the chamber 52*a* to move the diaphragm 40*a*, and therefore the shaft, to the left, whereupon the valve 150*a* closes. With continued leftward movement, fluid is pumped from the chamber 50*a* to the pump outlet, fluid is drawn from the pump inlet into the chamber 50*b*, and air in the chamber 52*b* is expelled to atmosphere through the port 102*b* and the manifold passages 124 and 126. During this time, compressed air again against enters the chamber 156*a* by leakage between the slide and the valve housing passage wall. Then, as the shaft closely approaches the leftward end of its travel, as shown in FIG. 3, the flange 110*b* engages and depresses the plunger 108*b* to open the valve 150*b* and cause the slide to rapidly and positively move the shift valve rightward to a position connecting the passage 122 with the passage 126, and the passage 124 with compressed air at the outlet 130. As a result, compressed air is now applied to the chamber 52*b* to move the diaphragm 40*b*, and therefore the shaft, to the right, whereupon the valve 150*b* closes. With continued rightward movement, fluid is pumped from the chamber 50*b* to the pump outlet, fluid is drawn from the pump inlet into the chamber 50*a*, and air in the chamber 52*a* is expelled to atmosphere through the port 102*a* and the passages 122 and 126. During this time, compressed air again enters the chamber 156*b*** as a result of leakage between the slide and the valve housing passage wall, whereupon the above described cycle of operation is repeated.

With compressed air applied to the pump its operation is, of course, determined by the pressure of the fluid at the outlet therefrom, such that when the outlet pressure equals the driving pressure of the air, as when fluid is not being drawn from the outlet, the pump is at a standstill. Then, when the outlet pressure begins to decrease a fluid is drawn therefrom, the pump again operates. The pressure of the fluid provided by the pump is thus readily regulated by controlling the pressure of the compressed air, no other means of regulation being required, and the pump at all times provides a standing head of fluid at a constant pressure.

In the event of failure of fluid to be provided to the pump, as may occur upon exhaustion of the supply thereof, emptying of both pumping chambers **50*a* and 50*b* may result in rapid and possibly damaging operation of the pump. To protect against such operation of the pump, and referring to FIGS. 4 and 5, a resettable low pressure or flow rate sensing air switch, sometimes referred to as a "slugcheck," is provided in the air supply line to the pump. The air switch, indicated generally at 160**, is normally open to permit a flow of air therethrough to the pump. Should the flow rate of the air become excessive, as may occur with rapid operation of the pump upon a failure of the fluid supply thereto, the switch automatically closes, until reset, to stop the pump.

More particularly, the switch 160 includes a housing 162 having a passage extending between a compressed air inlet 164 to the switch, for connecting with the supply of air, and an air outlet 166 from the switch, for connecting with the air inlet 104 to the pump. The housing forms a valve seat 168 in the passage upstream from a narrowed section 170 thereof, and an elongated cylindrical valve member 172, having an annular O-ring seal 174 at one end thereof and an annular flange 176 at an opposite end thereof, is slidingly positioned within the narrowed section of the passage. A reset plunger 178 is slidingly sealed with a passage through a fitting 180 by an O-ring 182, and extends at one end thereof to a manually engageable position exterior of the switch housing 162, and at an opposite end thereof interior of the housing to a position normally spaced from and aligned with the valve member 172. An annular flange 184 is formed around the plunger 178 toward the inner end thereof, and a coil spring 186 extends between the flanges 176 and 184 for normally urging the valve member seal 174 away from the valve seat 168.

Figure 4:
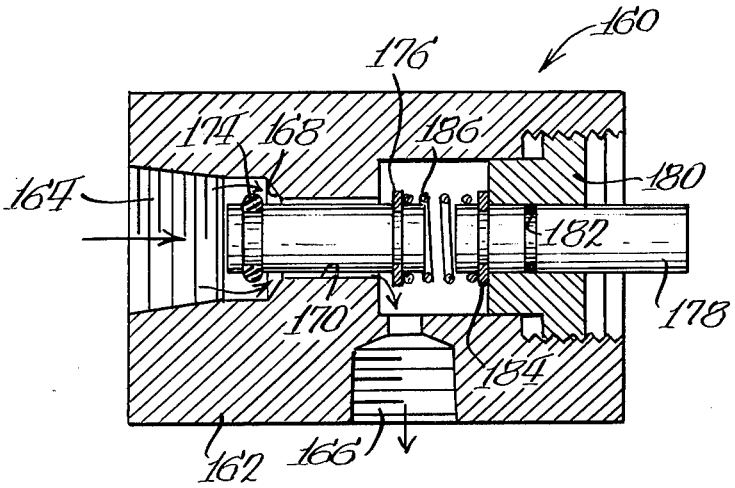
FIG. 4 is a cross-sectional view of a resettable valve in the air supply line to the pump, for automatically terminating the supply of compressed air to the pump in the event that the volume of air supplied thereto becomes excessive, showing the valve in its open position for providing air to the pump.
Figure 5:
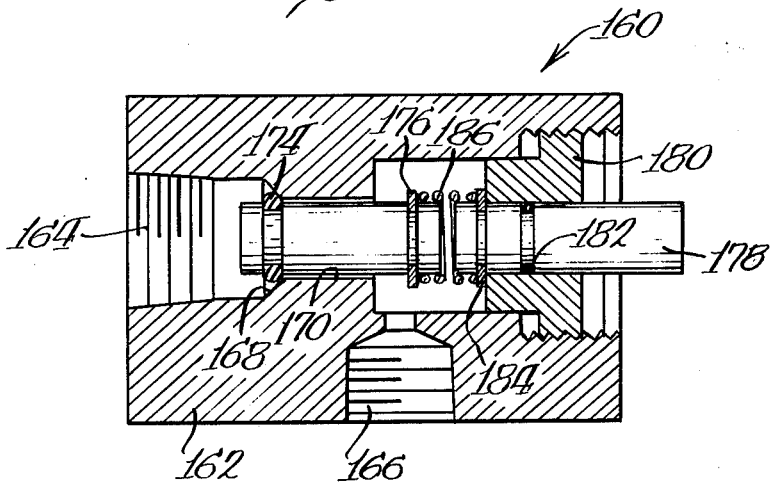
FIG. 5 is similar to FIG. 4, and shows the valve in its closed position for terminating the supply of air to the pump.

The relative diameters of the narrowed passage section 170 and of the valve member 172 are selected such that, with the valve open as shown in FIG. 4, a flow of compressed air for operating the pump is accommodated through the passage section and around the valve member for all flow rates up to a predetermined flow rate. The predetermined rate is that flow rate provided to the pump when the pump is operating at a predetermined maximum speed, and when the predetermined flow rate is reached the valve member 172 moves toward the reset plunger, against the urging of the spring 186, to engage the seal 174 with the valve seat 168, as shown in FIG. 5, to close the switch 160 and shut off the supply of air to the pump to stop the pump. Once closed, the switch then remains closed, as a result of the pressure of the air against the end of the valve member at the inlet to the switch, until the reset plunger 178 is manually moved into the switch to engage the valve member and to move the seal 174 from the valve seat 168 to again provide air to the pump.

The invention thus provides an efficient air or fluid operated reciprocating pump of economical construction. As a consequence of symmetry in the construction of the pump, particularly in the housing portions of the pump which advantageously are economically of molded plastic, the pump is quite economical to manufacture and easy to assemble. As a consequence of the use of the control valve means to rapidly and positively operate the directional valve means, as compared with operating the directional valve through a direct mechanical linkage with working parts of the pump, the periods at the ends of the pump strokes when compressed air is supplied to neither pumping cylinder are minimized, whereby the capacity and efficiency of the pump are increased, and the pressure of the fluid at the outlet from the pump remains substantially constant and is readily determined by the pressure of the air provided to the pump.

While one embodiment of the invention has been described in detail, various modifications and other embodiments thereof may be devised by one skilled in the art without departing from the spirit and the scope of the invention, as defined by the appended claims.

What is claimed is:

1. An air operated pump for fluids, comprising a pair of pumping stages, each including housing means forming an enlarged chamber therewithin, a flexible diaphragm positioned within said chamber and dividing said chamber into a fluid pumping section and an air receiving section, a pair of one way valve means in said housing means communicating with said pumping section, one of said valve means for passing fluid into said section and the other of said valve means for passing fluid from said section, an end closure on said housing means forming therewith fluid inlet and fluid outlet chambers, said end closure having an inlet to said fluid inlet chamber for being connected with a supply of fluid and an outlet from said fluid outlet chamber, said one valve means connecting said fluid inlet chamber with said housing means chamber and said other valve means connecting said housing means chamber with said fluid outlet chamber, said housing means having an air inlet port formed therethrough into said air section; means for mounting said housing means of said pumping stages in fixed relationship; a shaft extended between and secured at its opposite ends to said diaphragms constraining said diaphragms to conjoint reciprocating movement, such that said diaphragm of one of said stages moves into said pumping section thereof when said diaphragm of said other pump moves out of said pumping section thereof, and vice versa; directional valve means operable to apply compressed air from a source thereof selectively through one or the other of said ports into said associated air receiving section to move said diaphragm therein into said associated pumping section while venting the remaining air inlet port to atmosphere, and control valve means responsive to movement of said diaphragms toward the ends of their travel to operate said directional valve means to apply compressed air alternately through said ports, whereby said pumping stage diaphragms are reciprocatingly moved into and out of said pumping sections to alternately draw fluid from said inlets to said end closures into said pumping sections through said one valve means and to then expel said fluid to said end closure outlets through said other valve means, said one way valve means being flapper valves, said directional valve means including slide valve means connected between the source of air under pressure and said ports and movable between a first position for applying said air through one of said ports and a second position for applying said air through said other port, said control valve means being connected with said slide valve means and being responsive to said diaphragms closely approaching one end of their travel to move said slide valve means to said first position and to said diaphragms closely approaching the other end of their travel to move said slide valve means to said second position, said control valve means including first and second mechanically actuable valve means, said control valve means moving said slide valve means to said first position upon actuation of said first valve means and to said second position upon actuation of said second valve means, and means linking said first and said second valve means and said shaft upon said shaft closely approaching opposite ends of its travel for alternately actuating said first and second valve means, said linking means including a spool positioned around said shaft and having radial flanges at opposite ends thereof for engaging said valve means, said spool being movable with reciprocation of said shaft to alternately engage said first valve means with one of said flanges and said second valve means with the other of said flanges for actuating said valve means, said spool having a center tubular portion positioned around said shaft and said tubular portion having a longitudinal slot therein, said shaft having a radial pin extending into said slot and movable therein along the length thereof, said pin at opposite ends of shaft travel engaging ends of said slot to move said spool in directions to engage said first and second valve means with said flanges, said control valve means including a housing having a passage extending therethrough and a tubular member slidably received within said housing, said tubular member having a passage therethrough and an inner wall centrally located in said passage and closing said passage, whereby said tubular member closes said passage through said housing, said tubular member being connected with said slide valve means through a slot in said housing and movable within said housing passage to move said slide valve means between said first and said second positions, said first and said second valve means being positioned over and normally closing opposite ends of said housing passage and opening said respective end of said housing passage to atmosphere upon being actuated, and means for introducing air under pressure from said source thereof into said passage on opposite sides of said wall of said tubular member, whereby actuation of one or the other of said valve means by said spool vents to atmosphere compressed air in said passage on its respective side of said inner wall so that said tubular member is moved toward said actuated valve means by air under pressure on the opposite side of said wall to move said slide valve means to said first or said second position.

2. A pump as set forth in claim 1, said directional valve means including a manifold having a pair of passages therethrough, each connected with a respective one of said ports, and means connecting said manifold passages with the source of air under pressure, said slide valve means being positionable to block one of said passages from said connecting means when in said first position and to block the other of said passages from said connecting means when in said second position.

3. In an air operated pump as set forth in claim 2, said housing means being of plastic.

* * * * *